United States Patent [19]

Reider

[11] 4,232,527

[45] Nov. 11, 1980

[54] COMBUSTOR LINER JOINTS

[75] Inventor: Samuel B. Reider, Indianapolis, Ind.

[73] Assignee: General Motors Corporation, Detroit, Mich.

[21] Appl. No.: 29,781

[22] Filed: Apr. 13, 1979

Related U.S. Application Data

[63] Continuation-in-part of Ser. No. 923,811, Jul. 12, 1978.

[51] Int. Cl.[3] ..... F02C 7/18

[52] U.S. Cl. ..... 60/754; 60/759

[58] Field of Search ..... 60/728, 752, 754, 759

[56] References Cited

U.S. PATENT DOCUMENTS

| | | | |
|---|---|---|---|
| 3,737,152 | 6/1973 | Wilson | 60/39.66 |
| 3,742,704 | 7/1973 | Adelizzi et al. | 60/722 |
| 3,793,827 | 2/1974 | Ekstedt | 60/39.65 |
| 3,811,276 | 5/1974 | Caruel et al. | 60/39.65 |
| 3,845,620 | 11/1974 | Kenworthy | 60/39.65 |

*Primary Examiner*—Jerry W. Myracle
*Attorney, Agent, or Firm*—J. C. Evans

[57] ABSTRACT

A combustor apparatus for use in gas turbine engines includes an annular dome of porous laminated material joined by a solid metal joint ring to inner and outer annular porous wall segments also constructed of porous laminated material; and wherein the solid metal joint ring includes a plurality of small diameter offset effusion holes for directing coolant through the solid metal ring at a rate to cool it without entrapment of unburned fuel against the combustor walls; the combustor further including a transition mount including a solid metal support ring welded to the aft end of a porous laminated metal combustor wall, the mount including a seal ring retained by a keeper and a thin conical, axially extending beam portion that is flexible to serve to accommodate differential thermal expansion of the combustor relative to a grounded support component and wherein the solid metal support also includes a plurality of effusion cooling holes located immediately outboard of a weld bead between the solid metal support and the porous laminated combustor wall for cooling a downstream nozzle.

5 Claims, 7 Drawing Figures

COMBUSTOR LINER JOINTS

The invention described herein was made in the course of work under a Contract or Subcontract thereunder with the Department of Defense.

This is a Continuation-in-Part of U.S. Ser. No. 923,811, filed July 12, 1978, entitled COMBUSTOR LINER JOINTS.

This invention relates to gas turbine combustor apparatus, and more particularly, to such apparatus including wall components constructed of porous, laminated metal for flow of compressor discharge air from exteriorly of the combustion apparatus into an internal combustion chamber therein to transpiration cool the wall components during gas turbine engine operation and wherein the porous laminated wall components are joined by separate, solid metal joint rings.

Canister-type combustion apparatus and flame tube constructions are known to include a plurality of axially extending sleeve segments connected together by offset air distribution systems to provide wall cooling of the inner surface of a wall segment thereby to prevent excessive flame erosion of the wall segments during combustor operation. Typical examples of such systems are set forth in U.S. Pat. Nos. 3,811,276, issued May 21, 1974, to Caruel et al; 3,845,620, issued Nov. 5, 1974, to Kenworthy; 3,793,827, issued Feb. 26, 1974, to Ekstedt and 3,737,152, issued June 5, 1973, to Wilson. Experience has shown that such liner wall cooling can be effectively achieved with tangential film flow from the slots and louvers of the structures illustrated in the aforesaid patents. In combustors of this type relatively the tangential flows provide sufficient cooling air film protection for the inner walls of the combustor. Moreover, the large tangential flow through the slots and louvers are of nearly two dimensional flow contours which is an advantageous shield to the three dimensional flow fields in the reaction zones of combustion regions in the interior of combustor apparatus of gas turbine engines. The primary disadvantage of the aforesaid pure film cooling arrangements is that the heat sink potential of the cooling air is not fully utilized and moreover the cooling airflows can represent a significant portion of the total airflow entering the combustor, often in the order of 50–60% of the total airflow into the combustor. As combustor outlet temperatures increase, more diversion of total engine airflow for cooling is required. Such diversion can limit the total airflow for combustion with a resultant reduction in control of combustor flame pattern.

Accordingly, attention has been focused on film convection-type combustion apparatus liner cooling systems. An example of such an arrangement is set forth in copending U.S. Application Ser. No. 862,858, filed Dec. 21, 1977, now U.S. Pat. No. 4,195,475, by Albert J. Verdouw for Combustor Ring Attachment with a common assignee. In this arrangement an improved gas turbine combustor assembly is illustrated including a plurality of porous metal liner segments joined together by a solid metal ring at a butt weld connection between the solid metal ring and adjacent porous metal wall segments. Each liner wall segment is made of multiple laminated sheets of porous metal material as set forth in U.S. Pat. No. 3,584,972, issued June 15, 1971, to Bratkovich et al. Such material, when used in a gas turbine engine combustor has the characteristic of producing a wall of coolant flow on the inner surface of the combustor wall segments that will produce transpiration cooling of the multiple layers of the wall segments and further produce a layer of coolant to reduce the temperature of the inner surface of the combustor wall segments that are exposed to combustion flames within the combustor apparatus.

The desirability of such multiple laminated sheets of porous material in gas turbine engine combustors is that the metal of a wall will be maintained cool, moreover, it will be maintained at a uniform temperature which will be sufficiently elevated to assure vaporization of any raw fuel that strikes against the combustor wall during the combustion process to enhance burning of air and fuel in the reaction zone of the combustor apparatus.

Furthermore, the provisions of small diameter pores through the sheets of the porous laminated wall segments of the combustor apparatus produce a pressure differential across the wall segments that prevent excessive flow of coolant flow to the inner wall of the combustor. As a result, substantially greater quantities of combustion air are passed directly into the combustor as primary and secondary air for combustion with fuel components rather than being used solely for a wall cooling function. Thus, more effective fuel burning can be obtained by use of such porous laminated metal wall segments in the combustor apparatus.

In the aforesaid Verdouw application, a solid metal stiffening ring with an undercut tang formed thereon is located between adjacent panels of the porous metal laminated liner wall segment of a combustor assembly and a weldment fills a gap between adjacent ones of the laminated, porous metal wall segments to conduct heat from within the combustor to the reinforcing ring and to join adjacent ones of the laminated, porous metal wall segments. Such arrangements, while suitable for their intended purpose, do not define a mechanical interconnection between solid metal rings and porous laminated metal wall segments that are suitable for use in all gas turbine engine combustor apparatus and especially in those where wall segments are aligned with ends thereon radially offset from each other.

Accordingly, an object of the present invention is to provide an improved gas turbine engine combustor apparatus with a solid metal stiffening ring configuration having offset axial ends thereon connected to offset laminated porous metal wall segments and effusion holes therein to regulate airflow through the ring to only cool it and its connecting welds without reducing total combustor airflow and to thereby define a continuously air cooled, axial combustor liner from a domed inlet end to an outlet leading to inner and outer vane platforms on a gas turbine engine turbine nozzle.

Still another object of the present invention is to provide an improved solid metal joint ring to interconnect and stiffen axially spaced, radially offset porous laminated metal wall segments in a combustion apparatus each ring including offset, axially faced edge portions thereon connected by butt welds to exposed ends of the axially spaced, radially offset porous laminated wall segments of the combustor apparatus and each ring further including an outboard directed extension to stiffen the joined liner wall segments; the ring having a plurality of effusion cooling holes therethrough sized to convectively cool the main body portions of the solid metal ring to prevent thermal distortion therein during combustion apparatus operation. While maintaining a minimal diversion of total engine airflow from the primary, secondary and dilution holes of the combustor apparatus.

Still another object of the present invention is to provide an improved gas turbine engine combustor having solid metal connecting rings for joining wall segments of laminated porous metal forming offset liner wall portions of the gas turbine engine combustion apparatus and wherein the solid metal connecting rings include a pair of offset ends thereon joined to a reversely bent air scoop that directs combustion air through a primary air supply system; the ring including effusion cooling holes that are sized to direct air through the solid metal connecting ring at a reduced rate to cool it without unnecessarily diverting airflow through primary air holes in a first laminated porous metal wall segment in the primary air supply system and wherein the effusion hole airflow into the interior of the combustion apparatus does not trap fuel droplets in an eddy current pattern against the inside surface of the laminated porous metal segment.

Yet another object of the present invention is to provide an improved solid metal support ring assembly for a porous metal combustor transition duct for supplying hot exhaust gases from a combustion apparatus into a gas turbine nozzle ring wherein the support ring assembly includes a thick, radially extending segment on which is mounted a seal ring retained by a keeper and further including a thin, conically configured axially directed flexible beam portion of solid material that has an end thereof welded to the outlet end of the porous laminated metal transition duct and wherein the beam portion resiliently deflects to accommodate differential thermal expansion of the combustor apparatus transition duct relative to the support ring; the beam portion further including a plurality of circumferentially spaced, radially staggered effusion holes therein to direct compressor discharge air from plenum chambers surrounding the combustor apparatus to flow across inner and outer vane platform surfaces in a downstream located turbine nozzle without excessive diversion of total engine airflow from the combustor apparatus.

Still another object of the present invention is to provide an improved fuel nozzle connection to a laminated porous metal dome component of a combustor apparatus including a flanged support ring with an axial extension thereon welded at a hole in the porous laminated material and including a fuel nozzle ferrule having a radial flange thereon supported for free radial movement within a slot defined by the support ring and an externally secured keeper ring welded to the support ring in axially spaced relationship to the ferrule flange and wherein the support ring has a radial surface thereon for directing coolant flow radially inwardly of the connection between the support ring and the porous laminated dome to assure unobstructed flow of airflow through all portions of the dome to cool the inner surface thereof during combustor apparatus operation.

Further objects and advantages of the present invention will be apparent from the following description, reference being had to the accompanying drawings wherein a preferred embodiment of the present invention is clearly shown.

Figure 1:
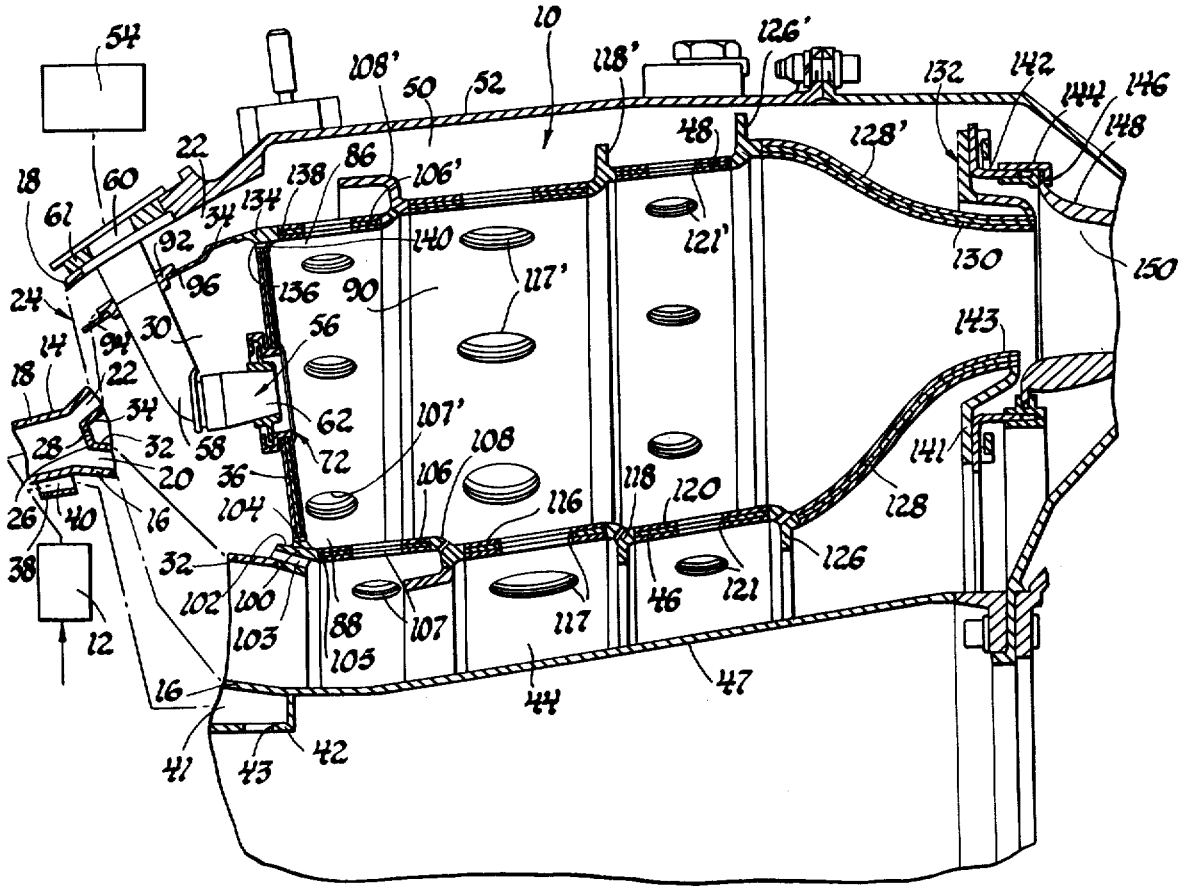
FIG. 1 is a longitudinal sectional view of a combustor apparatus constructed in accordance with the present invention.

Referring now to the drawings, a gas turbine engine combustor apparatus 10 is located downstream of a gas turbine air compressor, shown as an axial flow compressor 12. It discharges into an annular outlet passage 14 formed by an inner engine wall 16 and an outer engine wall 18 divergent from one another to form inner and outer passages 20, 22 on either side of an air distributing diffuser assembly 24. The diffuser assembly 24 includes an inlet snout 26 having an axial opening 28 therethrough which is aligned with the passage 14 to intersect a high velocity component of air discharge from the compressor 12 for distribution into an air supply chamber 30 formed between an inner wall 32 of the diffuser 24 and an outer wall 34 thereof at a point immediately upstream of an annular, porous laminated metal dome member 36 of the combustor apparatus 10.

Additionally, in the illustrated arrangement, part of the discharge air from the axial flow compressor 12 is directed to an annular scoop 38 having guide vanes 40 for distributing part of the airflow from the compressor 12 into a high pressure region 41 formed between the inner compressor wall 16 and an internal compartment wall 42 having an opening 43 therein for distributing airflow to mechanical components including turbine wheel components of the gas turbine engine for cooling them during gas turbine engine operation.

The aforesaid diversion of discharge air from the compressor 12 is illustrative of a bleed of compressed air from the airflow through the engine for use other than in maintenance of a combustion process in the combustor apparatus 10. Such diversion is necessary to maintain stable engine operation. However, flow requirements to maintain combustion in the apparatus 10 are such that there is an upper limit to such diversion. The present invention uses porous laminated wall and dome segments and unique solid metal connection joints therebetween to reduce such diversion as much as possible. Airflow to these components of the present invention is from the inner annular air passage 20 which leads to an inner annular plenum 44 located in surrounding relationship to an axially extending inner wall subassembly 46 of the combustor apparatus 10 between it and an inner engine wall 47. Likewise, the combustor assembly includes an outer wall assembly 48 that receives air from an annular outer air plenum 50 that is formed between the outer wall assembly 48 and an outer wall member 52.

In accordance with certain principles of the present invention a fuel supply 54 for the combustion assembly 10 includes a nozzle assembly 56 including an outboard directed strut 58 including an outboard end portion 60 thereon secured to a mounting pad 61 on the outer wall 18. The strut 58 includes a nozzle head 62 thereon of the type more specifically set forth in U.S. Pat. No.

Figure 7:
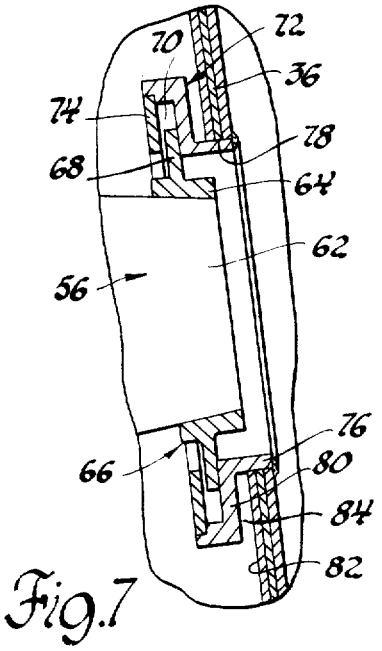
FIG. 7 is an enlarged, cross sectional view of a nozzle connector ring in the combustor apparatus of FIG. 1.

2,893,647, issued July 7, 1959, to D. E. Wortman. The head 62 is supportingly received by a cylindrical, open ended extension 64 on a free floating ferrule 66 that includes a radially directed flange 68 thereon slidably supported with a slot 70 formed between a support ring 72 connected to the dome 36 at one end thereof and to a keeper ring 74 at the opposite end thereof. The support ring 72 is configured to assure free flow of both combustion air and coolant air 30 through the dome 36. Thus, it includes a thin walled tubular extension 76 thereon that fits within a circular opening 78 in the dome 36, as best illustrated in FIG. 7 where it is welded in place. The tubular extension 76 is joined to a radially extending flange 80 on the support ring 72 that is spaced outboard of the outer surface 82 of the dome 36 to define an annular airflow passage 84 between the support ring 72 and the outer surface 82 so that air is free to flow throughout the full planar extent of the dome 36 except for the opening 78 formed therein. The arrangement assures uniform airflow across the dome 36 for maintenance of combustion with annular corner regions 86, 88 of a primary reaction or combustion zone 90 within the combustor assembly 10 immediately downstream of the dome 36.

In the illustrated arrangement the nozzle strut 58 is sealed with respect to the outer wall 34 by a metal plate 92 held with respect to the wall 34 by a pair of retainer flanges 94, 96.

The inner wall assembly 46 and outer wall assembly 48 combine with the dome 36 to provide a continuous flow of coolant from the plenums 44 and 50 into the interior of the combustor apparatus 10 to provide enough airflow to adequately remove heat from the walls to prevent an excessive temperature build-up therein. Moreover, the porosity of the laminated metal sheets which make-up the wall maintain a flow rate through both the wall assemblies 46, 48 to assure transpiration cooling at the inner surfaces thereof which face the burning fuel and air in the flame zone within the combustor apparatus 10. Moreover, a wall temperature is maintained to cause vaporization of fuel droplets that contact the wall assemblies 46, 48 for complete combustion with airflow through the combustor apparatus 10. In the illustrated arrangement, the porosity of the component parts of both the inner and outer walls 46, 48 and dome 36 is 0.006 square inch of open area for each square inch of porous laminated metal wall area. Such an arrangement maintains a cooled inner surface on the wall components without diverting excessive airflow from the combustion process which occurs within combustor apparatus 10.

The inner wall assembly 46 includes a first annular solid metal joint ring 100 that includes an outboard annular edge 102 with a scoop 103 that directs air from dome chamber 30 to plenum 44. Scoop 103 is welded to the wall 32. An array of effusion holes 104 are sized to allow controlled airflow through ring 100 to cool it without excessive air loss. Downstream edge 105 of ring 100 is welded to one edge of an annular laminated porous metal wall segment 106 with primary combustion air holes 107 therein to direct air from plenum 44 radially into combustion zone 90. Preferably the wall segment 106 has a porosity and holes 107 are sized to produce adequate combustion airflow for the apparatus 10 in the corner region 88. To assure this objective, the downstream end of the wall segment 106 is joined to a solid metal ring 108 that includes a reversally bent, outwardly extending scoop 110 thereon that is configured to assure a positive diversion of airflow through the primary (pilot) combustion air holes 107 and the pores through the laminated porous metal wall segment 106. The solid metal ring 108 particularly includes offset ends 112, 114 thereon connected respectively to the wall segment 106 and a downstream laminated porous metal wall segment 116. Wall segment 116 is located offset to wall segment 106 at a point radially outwardly thereof. A plurality of secondary (main) airflow holes 117 are formed in wall segment 116 to direct air into a part of zone 90 where main fuel flow is burned.

The inner wall assembly 46 has a solid metal joint ring 118 that joins and stiffens the annular laminated porous metal wall segment 116 to a downstream annular laminated porous metal wall segment 120 having a slightly lesser diameter than the wall segment 116. Wall segment 120 has a plurality of circumferentially spaced dilution holes 121 thereon. The solid metal ring 118 includes offset end segments 122, 124 thereon that are butt welded to the ends of the wall segments 116, 120, respectively. An additional solid metal ring 126, like ring 118, joins wall segment 120 to an annular transition duct 128 at the upstream end thereof. The transition duct 128 of the inner wall assembly 46 also is of a laminated porous metal construction and includes a downstream end 130 thereon connected to an improved support 132 to be described.

Since the illustrated embodiment is in an annular combustor, the inner wall assembly 46 includes components separate from those illustrated with respect to the outer wall assembly 48. For purposes of simplifying this description, parts in the outer wall assembly 48 which correspond to like components in the inner wall assembly 46 are designated with the same reference numerals primed, it being understood that they have the same functional purpose and same mechanical interrelationship to the like components found in the inner wall assembly 46 of the combustor apparatus 10.

The outer wall assembly 48 differs at a solid metal outer corner ring 134 that joins the outer annular edge of the dome 36 to the upstream edge of the panel member 106' of the outer wall assembly 48. The solid metal ring 134 in this case includes a radially inwardly directed edge 136 thereon connected to the dome 36 and a downstream edge 138 that connects to the panel 106'. Additionally the solid metal ring 134 has a plurality of effusion holes 140 that divert a controlled airflow through ring 134 solely to cool it and its connection welds and at a rate below that required to produce any downstream wall cooling effect.

Referring now more specifically to FIGS. 2 through 6, it will be seen that solid metal connecting rings in the wall assemblies 46 and 48 are configured to define an easily jointed structure while avoiding excessive diversion of flow of coolant from the total airflow through the gas turbine engine. Support 132 has a counterpart 141 connected to end 143 of duct 128.

Figure 2:
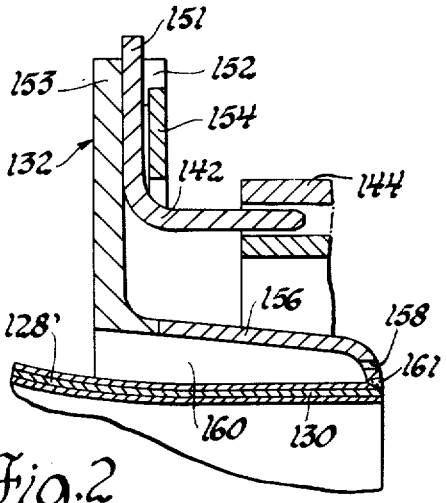
FIG. 2 is en enlarged, fragmentary sectional view of a transition duct support ring in the combustion apparatus of the present invention.

More particularly, as shown in FIG. 2 the support 132 includes a locater member 142 that is supported for free axial movement by a slotted end of an annular member 144 that is carried for free radial expansion with respect to an upstream end plate 146 on an outer shroud 148 of a turbine nozzle 150. The locator 142 includes a radially outwardly directed end 151 thereon that fits within a slot 152 on a flange 153. The end 151 is held with respect to the flange 153 by a keeper ring 154. The support 132 includes a thin conically configured, axially extending beam 156 with a plurality of circumferentially spaced airflow effusion holes 158 therein to permit flow of coolant from an annular space 160 between the beam 156 and an end 130 on the transition duct 128. The end 130 is connected and sealed by weld 161 to the end of the beam 156 at a point radially inboard of the effusion holes 158 which direct a controlled amount of coolant flow across the exposed surface of the outer shroud 148 of the nozzle 150. The beam 156 is thin enough to have a resilient deflection that will accommodate differential thermal expansion of the transition duct 128 relative to the support 132. The support is free to move axially within the slotted member 144 and radially with respect to the end plate 146 to further compensate for differences in operating temperatures at the outlet of the combustion apparatus 10.

Figure 3:
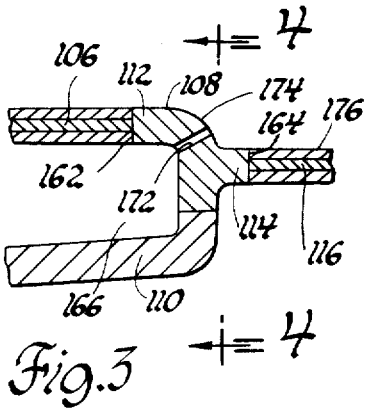
FIG. 3 is a fragmentary, enlarged sectional view of a combined scoop and solid metal stiffening ring in the combustion apparatus of FIG. 1.

Referring to FIG. 3, the solid metal connector and scoop ring 108 is shown enlarged. The offset ends 112, 114 are connected by tungsten inert gas welds at 162, 164. They are representative of all the welded connections between previously discussed solid metal rings and adjacent connected laminated porous metal wall segments of the combustion apparatus 10.

Figure 4:
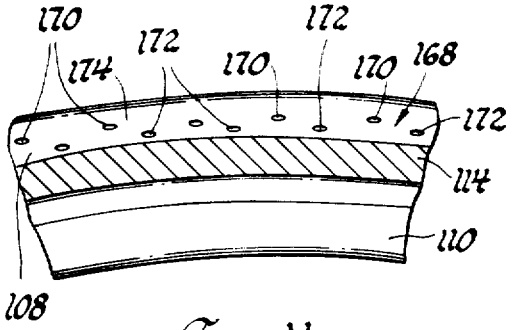
FIG. 4 is a vertical sectional view taken along line 4—4 of FIG. 3 looking in the direction of the arrows.

The rebent end or scoop 110 of the ring 108 overlies approximately one third of the total axial length of the liner wall segment 106 to provide a pocket 166 that leads to an array 168 of circumferentially spaced effusion holes including a ring of holes 170 and a second plurality of radially spaced, like effusion holes 172. Each of the effusion holes 170, 172 directs airflow from the pocket 166 to produce a low velocity flow of coolant directly across an inwardly facing curved surface segment 174 of the ring 108 as best shown in FIGS. 3 and 4. The area of flow through the effusion cooling holes 170, 172 is selected to provide sufficient flow of air through the solid metal ring 108 to maintain it and its connection cooled during combustor operation. However, the area of each of the individual cooling holes is selected so that the flow of air across the curved surface 174 will be dispersed into the main combustion flow patterns within the primary combustion zone 90 without producing a high velocity air film at the inner surface 176 of the wall segment 116. The panel 116 itself has a porosity and airflow therethrough sufficient to cool its own inner surface 176 and since the airflow rates through the openings 170, 172 are selected to prevent high velocity jets at the surface 176 there is no tendency to form eddy currents to trap fuel droplets against the inner surface of the outer wall assembly 48.

Figure 5:
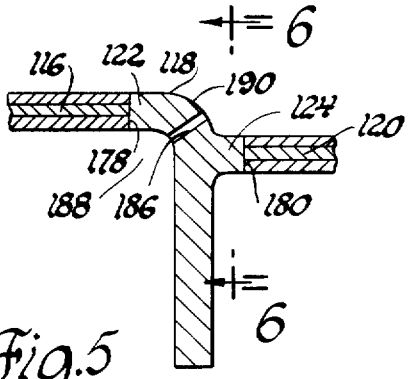
FIG. 5 is an enlarged, fragmentary sectional view of a solid metal ring for connecting and reinforcing offset laminated porous metal wall segments of the combustor apparatus in FIG. 1.
Figure 6:
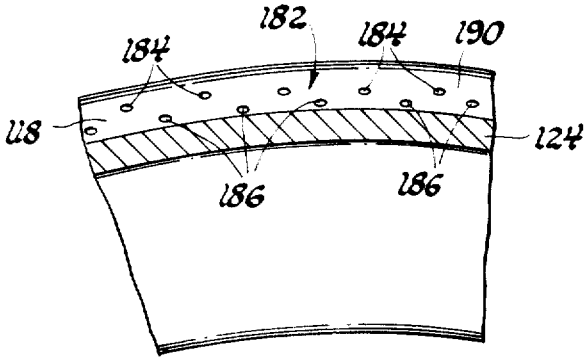
FIG. 6 is a vertical sectional view taken along the line 6—6 of FIG. 5 looking in the direction of the arrows.

FIGS. 5 and 6 show rings to interconnect and reinforce axially spaced wall segments 116 and 120 of the inner wall 46. More particularly, as shown in FIG. 5, the ring 118 includes offset ends 122, 124 thereon that join the offset wall segments 116, 120 at weld connections 178 and 180. An array of effusion holes 182 in ring 118 includes a first row of holes 184 spaced circumferentially from one another and radially outwardly of a second row of effusion holes 186 spaced circumferentially from one another as best seen in FIG. 6. The array 182 extends from a pocket 188 to a curved surface 190 corresponding to the curved surface 174 in FIG. 3. The flow through the effusion hole array 182 corresponds to that in the embodiment in FIGS. 3 and 4 and the total flow area of the holes 186, 188 is selected to cool the solid metal ring 118 without producing a high velocity jet flow interiorly of the combustor apparatus 10. The flow through the array 182 will disperse into the primary flow pattern within the combustion chamber 90 of the assembly 10 without formation of wall eddy currents. The array 182 is not used for cooling flow across the inner surfaces of the panel 116, 120, since wall coolant flow is established by the pressure differential across the wall segments from the inner plenum 44 into the interior of the combustion apparatus 10.

The array of effusion holes illustrated at 168 and 182 are thus characterized as having a limited airflow thereacross since there is not need to produce an axially directed air film for shielding the inner surfaces of the walls 116, 120. As a result, the solid metal rings and the coolant flow therethrough is substantially reduced as compared to prior art ring configurations that are configured to direct enough airflow across the inner walls of the combustor assembly to shield the inner surfaces thereof from the combustion process.

Thus, in the illustrated arrangement, because of the provision of laminated porous metal panels and effusion holed, solid metal joint rings to form the inner and outer wall assemblies 46, 48, the amount of airflow diverted for wall cooling is reduced so that a greater percentage of the total compressor airflow can be used for combustion processes within the interio of the combustor apparatus 10.

While the embodiments of the present invention, as herein disclosed, constitute a preferred form, it is to be understood that other forms might be adopted.

The embodiments of the invention in which an exclusive property or privilege is claimed are defined as follows:

1. In a combustor for a gas turbine engine including a compressor discharging into a combustor diffuser directing discharge flow from the compressor for uniform distribution to a dome plenum the improvement comprising: an annular porous liner wall segment, said liner wall segment defining a combustion zone downstream of said dome, said porous liner wall segment directing compressed air radially inwardly of the combustor at a point downstream of the dome plenum to cool the inner surfaces thereof by transpiration cooling, said wall segment having an inlet end thereon and an outlet end thereon, a solid metal joint ring welded to said inlet end to define a sealed joint, said solid metal joint ring including a plurality of small diameter effusion holes sized to direct cooling air from the plenum through said solid metal joint ring at a rate to cool the mass of said ring without producing a tangential wall stream on the inner surface of said porous liner wall segment thereby to direct heat from the sealed joint and said porous liner wall segment to maintain structural integrity therebetween without excessive diversion of total engine airflow from the plenum.

2. In a combustor for a gas turbine engine including a compressor discharging into a combustor diffuser directing discharge flow from the compressor for uniform distribution to a dome plenum the improvement comprising: an annular porous liner wall segment, said liner wall segment defining a combustion zone downstream of said dome, said porous liner wall segment directing compressed air radially inwardly of the combustor at a point downstream of the dome plenum to cool the inner surfaces thereof by transpiration cooling, said wall segment having an inlet end thereon and an outlet end thereon, a solid metal joint ring welded to said inlet end to define a sealed joint, said solid metal joint ring including a plurality of small diameter effusion holes sized to direct cooling air from the plenum through said solid metal joint ring at a rate to cool the mass of said ring without producing a tangential wall stream on the inner surface of said porous liner wall segment thereby to direct heat from the sealed joint and said porous liner wall segment to maintain structural integrity therebetween without excessive diversion of total engine air flow from the plenum, said solid metal ring having offset ends thereon, one of said offset ends being welded to said wall segment, another porous liner wall segment joined to the other offset end, said solid metal ring having a convexly curved inner surface flush with the inner surfaces of said wall segment and the inner surfaces of said outer wall segment and wherein said effusion holes are directed through said solid metal ring to intersect said convexly curved surface for dispersion therefrom into the combustion zone without formation of a two dimensional tangential wall film on the inner surface of said other porous liner wall segment.

3. In a combustor for a gas turbine engine including a compressor discharging into a combustor diffuser directing discharge flow from the compressor for uniform distribution to a dome plenum the improvement comprising: an annular porous liner wall segment, said liner wall segment defining a combustion zone downstream of said dome, said porous liner wall segment directing compressed air radially inwardly of the combustor at a point downstream of the dome plenum to cool the inner surfaces thereof by transpiration cooling, said wall segment having an inlet end thereon and an outlet end thereon, a solid metal joint ring welded to said inlet end to define a sealed joint, said solid metal joint ring including a plurality of small diameter effusion holes sized to direct cooling air from the plenum through said solid metal joint ring at a rate to cool the mass of said ring without producing a tangential wall stream on the inner surface of said porous liner wall segment thereby to direct heat from the sealed joint and said porous liner wall segment to maintain structural integrity therebetween without excessive diversion of total engine air flow from the plenum, said solid metal ring having offset ends thereon, one of said offset ends being welded to said wall segment, another porous liner wall segment joined to the other offset end, said solid metal ring having a convexly curved inner surface flush with the inner surfaces of said wall segment and the inner surfaces of said outer wall segment and wherein said effusion holes are directed through said solid metal ring to intersect said convexly curved surface for dispersion therefrom into the combustion zone without formation of a two dimensional tangential wall film on the inner surface of said other porous liner wall segment, said annular porous liner wall segment forming a transition duct from the combustor, a support ring for said duct including a conically configured, axially extending beam member welded to said outlet end of said porous liner wall segment and having a resilient deflection to accommodate thermal expansion of said duct with respect to said support ring, an upstream surface on said beam member in communication with compressor discharge air, and effusion holes in said beam member at its weld connection to said outlet end, said holes sized to produce a coolant flow across said weld connection for cooling it without excessive diversion of total engine airflow.

4. A combustor for a gas turbine engine including a compressor discharging into an annular combustor diffuser with a flow director therein including an annular snout dividing discharge flow from the compressor for uniform distribution to an outer annular combustor plenum, a domed chamber and an inner annular combustor plenum comprising: a porous laminated annular dome, first inner and an outer annular porous wall segments, said inner and outer segments and dome defining a combustion zone downstream of said laminated dome and also directing compressed air from the annular inner and outer diffuser plenums radially inwardly of the combustor at a point immediately downstream of the laminated annular dome member to cool the inner surfaces thereof by transpiration cooling, each of said inner and outer wall segments having an inlet end thereon and an outlet end thereon, a solid metal joint ring welded to each of said inlet ends and to said laminated dome to define a sealed joint between said porous laminated dome and said inner and outer wall segments, each of said solid metal joint rings including a plurality of small diameter effusion holes sized to direct cooling air from the domed chamber through each of said solid metal joint rings at a rate to cool the ring mass without producing a tangential wall stream on the inner surface of the first wall segment thereby to direct heat from the connection between said joint ring and adjacent laminated segments of said dome and said inner and outer wall segments to maintain structural integrity therebetween, a second solid metal joint ring connected by welds to each of said first inner and outer segments at the downstream end thereof, each of said second solid metal joint rings including a rebent end thereon to define a scoop for directing compressor discharge air to a selected area of the outer surface of each of said first and second annular porous wall segments for flow into the combustion zone, a second outer annular porous wall segment and a second inner annular porous wall segment on said combustor each weld connected to one of said second solid metal joint rings, said second solid joint ring having a plurality of effusion cooling holes therein for directing coolant from the scoop through the second solid metal ring at a flow rate to cool it and adjacent weld connections to said second inner and outer wall segments without excessive diversion of engine airflow or formation of a tangential wall stream of the inner surface of the second inner and outer wall segments and thereby to maintain a high strength structural connection at the weld without excessive diversion of total engine airflow for tangential airflow across the last mentioned inner surfaces.

5. A combustor for a gas turbine engine including an axial flow compressor discharging into an annular combustor diffuser with a flow director therein including an annular snout dividing discharge flow from the axial compressor for uniform distribution to an outer annular combustor plenum and a domed chamber comprising: a porous laminated dome, an annular porous liner wall segment, said liner wall segment and dome defining a combustion zone downstream of said laminated dome and also directing compressed air from the outer diffuser plenum radially inwardly of the combustor at a point immediately downstream of the laminated annular dome member, said dome having an opening therethrough, a support ring having a thin walled tubular extension with an end welded to said dome at the hole therein, a flange on said support ring spaced upstream of the outer surface of said dome to form an annular opening to supply air from said domed chamber for directing coolant air flow axially through said dome completely around the outer surface of said extension, a nozzle support ferrule axially slidably supported within said thin walled extension, said ferrule including a radially outwardly directed flange thereon, a fuel supply nozzle supported within said ferrule for directing fuel into said combustion zone, and means for supporting said ferrule flange for free radial movement with respect to said support ring without blockage of said annular opening whereby coolant airflow is maintained through said dome through all the fuel surface extent thereof while said dome is free to both axially and radially expand with respect to said nozzle during combustor operation.

* * * * *